US005421755A

United States Patent [19]

Kakizaki

[11] Patent Number: 5,421,755

[45] Date of Patent: Jun. 6, 1995

[54] STEERING HANDLE

[75] Inventor: Toshihiro Kakizaki, Iwata, Japan

[73] Assignee: Sanshin Kogyo Kabushiki Kaisha, Shizuoka, Japan

[21] Appl. No.: 143,336

[22] Filed: Oct. 25, 1993

[30] Foreign Application Priority Data

Oct. 23, 1992 [JP] Japan ..... 4-307850
Nov. 5, 1992 [JP] Japan ..... 4-319250

[51] Int. Cl.[6] ..... B63H 5/12

[52] U.S. Cl. ..... 440/63; 440/86; 440/87

[58] Field of Search ..... 440/53, 61, 63, 84, 440/85, 86, 87; 74/480 B

[56] References Cited

U.S. PATENT DOCUMENTS 4,582,493 4/1986 Toyohara et al. ..... 440/84
4,726,798 2/1988 Davis ..... 440/86
4,801,282 1/1989 Ogawa et al. ..... 440/84
5,122,084 6/1992 Lieb et al. ..... 440/86

OTHER PUBLICATIONS

Page from shop manual (date presently unknown).

*Primary Examiner*—Stephen P. Avila
*Attorney, Agent, or Firm*—Knobbe, Martens, Olson & Bear

[57] ABSTRACT

Several embodiments of steering controls for connection to larger displacement outboard motors that are normally remotely controlled. Each tiller assembly includes at least a throttle control that is connected to the throttle control cable of the outboard motor and a transmission control that is connected to the transmission control cable of the outboard motor. In addition, embodiments of interlocks are depicted that are supported in the tiller assembly and which control the maximum speed of the engine when the transmission is in neutral or reverse and which also prevents shifting into these speeds when the outboard motor is being operated at speeds higher than the those maximum permitted in their respective transmission speeds.

25 Claims, 8 Drawing Sheets

STEERING HANDLE

BACKGROUND OF THE INVENTION

This invention relates to a steering handle for an outboard motor and more particularly to a steering handle and associated controls useable in conjunction with outboard motors.

As is well known, outboard motors are highly popular types of propulsion devices for watercraft of a wide variety of types and sizes. Basically, the smaller sized watercraft are powered by smaller displacement and horsepower outboard motor and normally these outboard motors are designed with a steering tiller that is affixed to the steering shaft of the outboard motor for its steering movement and which also contains other controls for the outboard motor such as a throttle and, at times, a transmission control. The most common type of throttle control is a grip throttle control which is connected to the throttle of the engine of the outboard motor for controlling its speed.

With larger displacement outboard motors, however, it is the normal practice to employ remotely positioned controls both for the steering, throttle and transmission of the outboard motor. These controls are normally coupled from a remotely positioned control location to the various components of the outboard motor to be controlled by bowden wire cables.

There are, however, many instances wherein it is desirable to control the larger displacement, larger horsepower outboard motors from a steering tiller similar to that type of control employed with smaller displacement outboard motors. However, this type of construction presents certain difficulties which will be apparent by the description of the prior art constructions and a general description of the type of outboard motor with which the invention may be practice as will now follow by reference to FIGS. 1 through 4 of the drawings.

Referring first to FIG. 1, an outboard motor of a generally conventional type, but which may be constructed to incorporate the invention is illustrated and is identified generally by the reference numeral 21. The outboard motor 21 includes a powerhead 22 that is comprised of a powering internal combustion engine, shown diagrammatically at 23 and a surrounding protective cowling, indicated generally by the reference numeral 24 and which is comprised of a lower tray portion 25 and a detachable main cover portion 26.

As is typical with outboard motor practice, the engine 23 is supported so that its output shaft rotates about a generally vertically extending axis and is coupled to a drive shaft (not shown) that is journalled in a drive shaft housing 27 that is connected to the underside of the powerhead. This drive shaft depends through the drive shaft housing 27 into a lower unit 28 wherein a forward, neutral, reverse transmission of the conventional bevel gear type, robe described later by reference to another Figure, is provided for driving a propeller 29 in a selected forward or reverse direction.

A steering shaft 31 is affixed to the drive shaft housing 27 by upper and lower brackets 32 and 33 and is supported for steering movement within a swivel bracket 34 which steering movement occurs about a generally vertically extending steering axis. A steering arm 35 is connected to the upper end of the steering shaft 31 for the steering of the outboard motor 21 in a manner which will be described.

The swivel bracket 34 is, in turn, pivotally connected by means of a pivot pin 36 to a clamping bracket 37 for tilt and trim movement of the outboard motor 21. A clamping device 38 is connected to the clamping bracket 37 to provide a detachable connection to a hull 39 of an associated watercraft. The construction as thus far described may be considered to be conventional and, for that reason, further description is not necessary for those skilled in the art to understand both the background of this invention and the described preferred embodiments.

Referring now to FIGS. 2 and 3, a further description of the conventional construction and a conventional way in which larger displacement outboard motors are adapted for tiller control will be described. It should be noted that with a conventional construction, a transmission selector control wire 41 extends outwardly from the forward portion of the outboard motor 21 and is normally designed to be connected to a remotely positioned shift control lever. However, when conventional large displacement outboard motors are modified so as to accommodate tiller control, a shift control lever 42 will be mounted on the steering arm 35 and connected by means of a connection 43 to the wire actuator for transmission control.

In addition, a combined steering and control handle 44 is provided with a pivotal connection to the steering arm 35 about a horizontally disposed axis from an operative position as shown in FIGS. 1 and 2 to an elevated storage position. This steering control 44 includes an outer housing assembly 45 with a twist grip throttle 46 rotatably journalled at its outer end for rotation about a longitudinal axis 47 in directions indicated by the arrow 48.

Contained within the interior of the steering handle body 45 is a shaft 49 to which the throttle control 46 is connected. A pulley 51 is affixed to this shaft 49 and has a wire actuator 52 encircling it which is connected to a throttle control wire actuator 53 of the outboard motor 21. The wire actuator 53 is normally designed to be connected to a remote throttle mechanism and in order to accommodate tiller control as shown in the drawings, it is necessary to bend the cable 53 through a fairly substantial angle and this provides not; only an unsightly appearance, but also an extending member that can become entangled with various paraphernalia which may be used by the users of the watercraft such as fishing line, nets or the like. Clearly, this is not a satisfactory arrangement.

FIG. 4 shows another prior art way of converting a conventional larger displacement outboard motor into tiller control. Again, the tiller control is identified generally by the reference numeral 44A and where components are the same as the type of prior art construction shown in FIGS. 2 and 3, they have been identified by the same reference numerals. However, where the components are different, they will be identified by the same reference numerals with the suffix "A" added. In this embodiment, the handle assembly 45A also supports a twist grip throttle 46 which, in this type of construction, is connected to a shaft 49A having a helical screw element 51A connected to it. This screw element 51A cooperates with a follower 54 that is affixed to the forward end of the throttle control 53 and which has a groove 56 that cooperates with the helical member 58 so as to reciprocate the control wire 53 upon rotation of the throttle grip 46. Although this type of arrangement provides a neater appearance, the screw and nut connection does not afford a significant degree of mechanical advantage due to the amount of reciprocal motion must be generated for a relatively small amount of rotary motion. Therefore, this type of twist grip throttle requires high operational forces and is not at all satisfactory.

It is, therefore, a principal object to this invention to provide an improved steering handle assembly for outboard motors.

It is a further object to this invention to provide an improved steering handle and control assembly for outboard motors that may be utilized with large displacement outboard motors that are normally designed to be operated remotely and to convert these into tiller operation.

It is a further object to this invention to provide an improved arrangement for affording a neat compact and yet extremely useful tiller control for a large displacement outboard motor.

As has been previously noted, most outboard motors, particularly those of larger displacement, employ a forward, neutral, reverse transmission in addition to throttle control and steering control. These transmissions are conventionally bevel gear type transmissions that are operated by dog clutches. Of course, the dog clutching mechanism is an all-on or all-off type of device and can result in sudden impact with shifts occur and also abrupt movements.

The inherent problems with the transmission coupled with the fact that the throttle controls normally are designed to stay in a fixed position if the operator releases them can give rise to certain problems. Therefore, it is conventionally the practice to incorporate within the body of the outboard motor a interlock mechanism between the transmission and throttle control which limits the speed at which the engine can be driven when in certain gears or which, alternatively, blocks shifting when the throttle control is opened too widely. However, these types of arrangements when positioned inside of the casing of the outboard motor do not afford ease of adjustment. Furthermore, when a large displacement outboard motor is adapted to accommodate a tiller control, the mechanism normally employed for controlling the interrelationship of engine speed and transmission control is not acceptable.

It is, therefore, a still further object to this invention to provide an improved combined throttle and transmission control for an outboard motor wherein the speed of the throttle is limited in relation to the transmission condition.

SUMMARY OF THE INVENTION

A first feature of this invention is adapted to be embodied in a combined steering handle and control for an outboard motor having a controlled element and a wire actuator connected to the controlled element for operating the controlled element. The wire actuator has an end extendingly forwardly from the outboard motor. The steering handle and control is comprised of a main body portion adapted to be affixed to the outboard motor for effecting steering movement of the outboard motor. A control portion is rotatably journalled at a forward end of the body portion about a longitudinally extending axis and motion transmitting means contained within the main body portion translate rotary motion of the control portion about the longitudinal axis into rotation of an operating element about an axis traverse to the longitudinal axis. Connecting means connect the operating element to the wire actuator for its actuation in response to movement of the control portion.

In accordance with another feature of the invention, a combined steering and control handle assembly for an outboard motor consists of a main body portion having a transmission control mounted thereon and adapted to be connected to a transmission of an outboard motor for moving the transmission at least between a forward drive position and a neutral position. A throttle control is rotatably journalled at the forward end of the body portion and is adapted to be connected to a throttle control of the outboard motor for controlling the speed of the outboard motor in response to rotation of the throttle control portion. Interlock means are provided in the main body portion between the shift control and the throttle control for limiting the movement of the shift control to the neutral position when the throttle control is opened more than a predetermined degree and for precluding opening of the throttle control beyond the predetermined degree when the shift control is in its neutral position.

DETAILED DESCRIPTION OF THE PREFERRED EMBODIMENTS OF THE INVENTION

Figure 1:
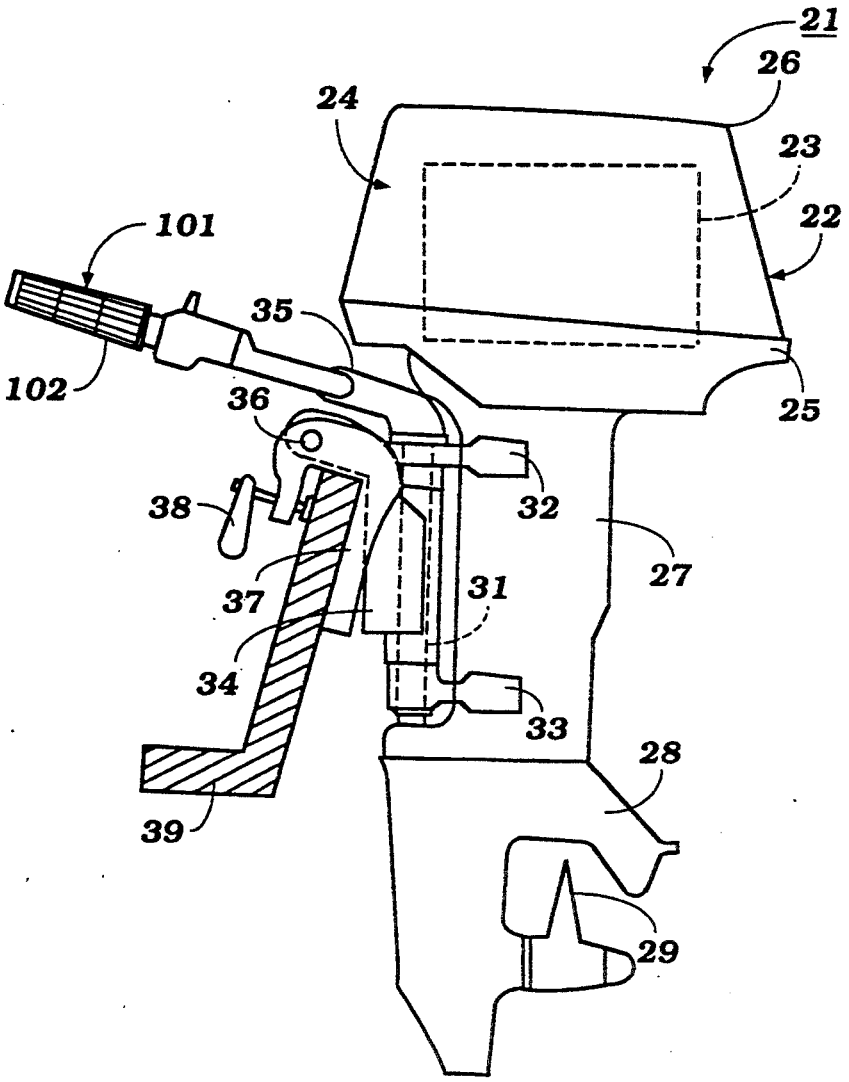
FIG. 1 is a side elevational view of an outboard motor illustrative of the environment in which the invention may be employed and showing a first embodiment of the invention.

Referring again initially to FIG. 1, the conventional outboard as thus far described is shown as having attached to it a steering and throttle control lever assembly, indicated generally by the reference numeral 101 connected to the steering arm 35 and which includes a twist grip throttle control 102. This construction is shown in more detail in FIGS. 5 and 6 and will now be described in particularly detail to those Figures.

The control 101 is comprised of a main body portion 103 with the throttle control 102 being rotatably journalled at the outer end thereof about a longitudinally extending axis 104 in the direction of the arrow 105. The body portion 103 is generally hollow and receives a throttle control rod 106 that is coupled for rotation with the throttle control 102 and which is journalled in a bearing 107 of the body assembly 103. A bevel gear motion translation mechanism, indicated generally by the reference numeral 108, is positioned within the interior of the handle body 103 for transmitting rotary motion about the longitudinal axis 104 into rotary motion about a transversely extending axis 109.

This transmission includes a driving bevel gear 111 that is affixed for rotation with the throttle control shaft 106 in an appropriate manner and which meshes with a bevel driven gear 112 that is affixed to a shaft 113 which is journalled suitably for rotation about the axis 109 by means of a drive pin 114. The bevel gear 112 is shown mounted on one side of the driving bevel gear 112, but alternative opposite side location is shown by the phantom line position 1117 in this Figure. Which the side the gear 112 is placed on will depend upon the direction in which the throttle control 102 is to be operated depending upon the particular outboard motor employed.

An operating lever 115 is also affixed for rotation with the shaft 113 on one side of the housing assembly 103 and has connected to it a connector 116 that is connected to the end of the bowden wire actuator 53 in a well known manner. The sheath of the bowden wire is mounted within the outer housing assembly 103 on a mounting bracket 117.

Figure 6:
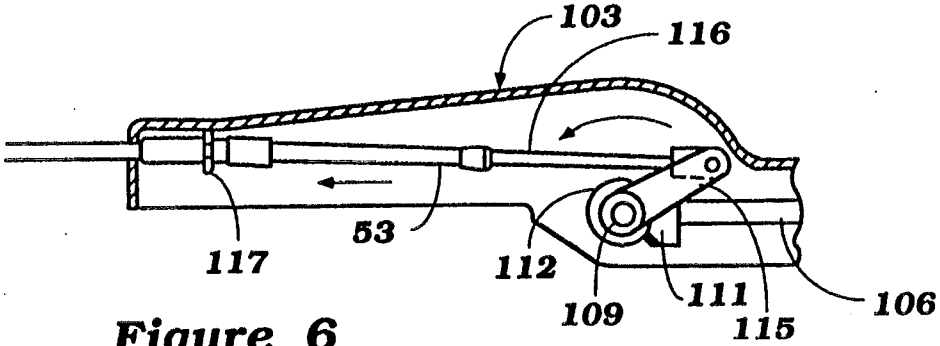
FIG. 6 is a cross sectional view taken along the line 6—6 of FIG. 5.
Figure 7:
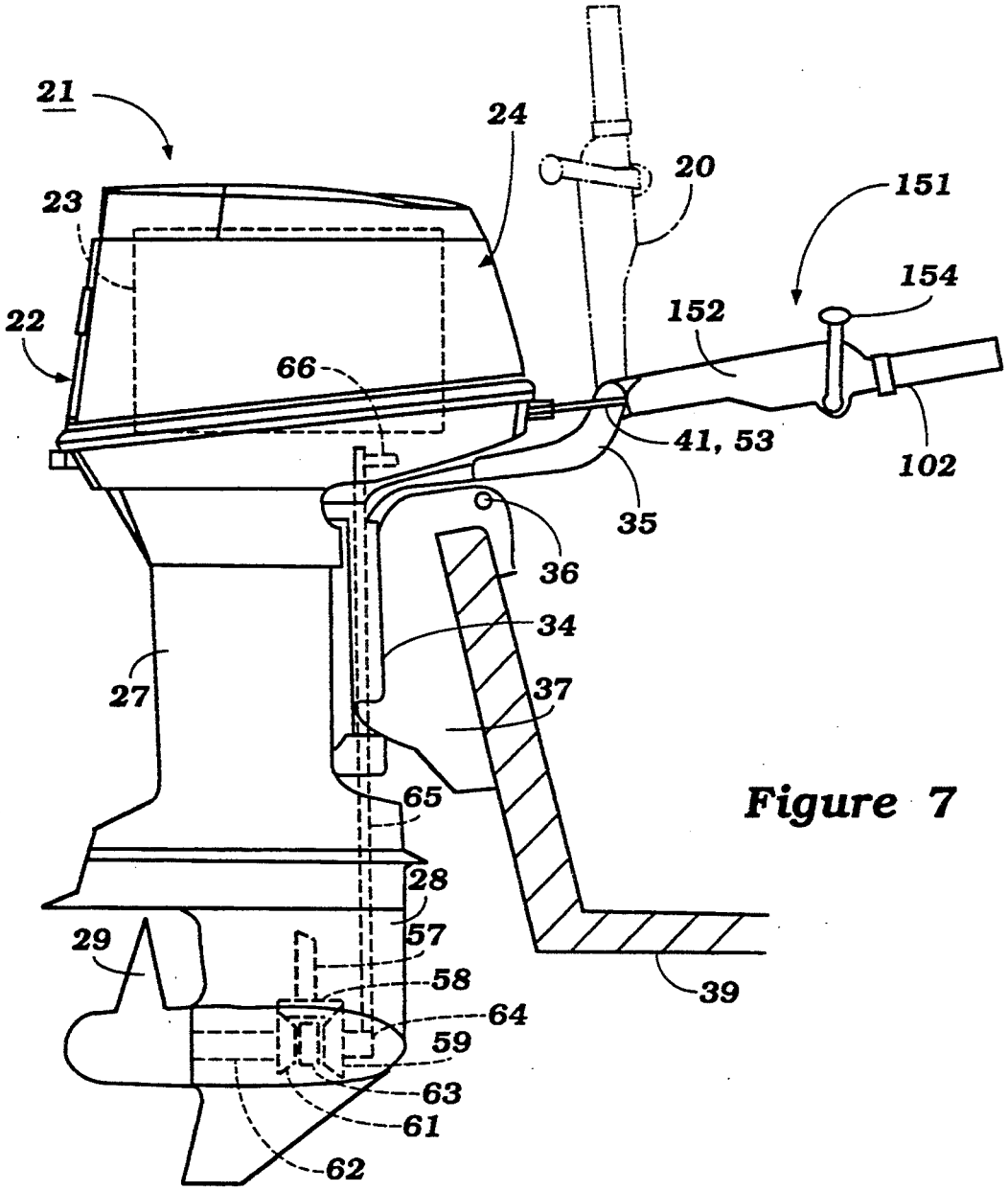
FIG. 7 is a side elevational view, looking from the side opposite to FIG. 1, and shows another embodiment of the invention as incorporated in an outboard motor attached to the transom of an associated watercraft.
Figure 8:
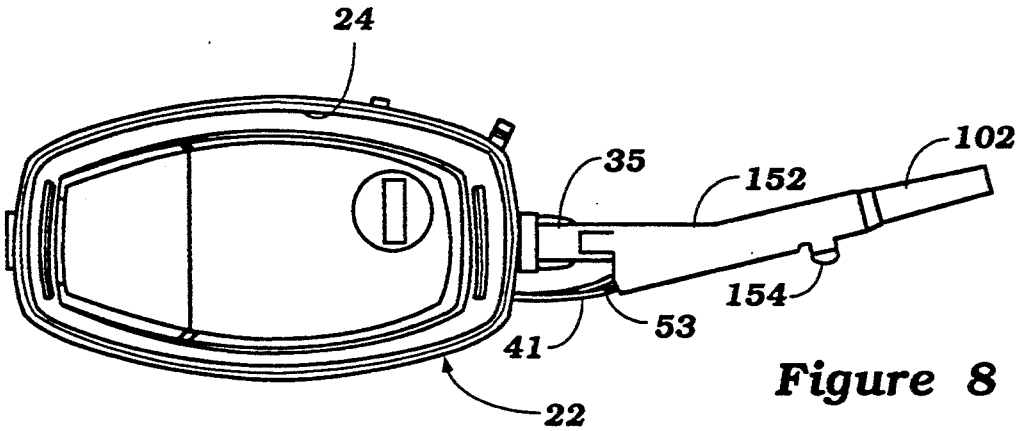
FIG. 8 is a top plan view of the construction shown in FIG. 7.

It should be noted from FIG. 6 that the outer end of the lever 115 where the connector 116 is attached is spaced outwardly beyond the periphery of the bevel gear 112. This not only provides clearance, but gives a mechanical advantage to the operator so as to provide ease of throttle control.

Figure 5:
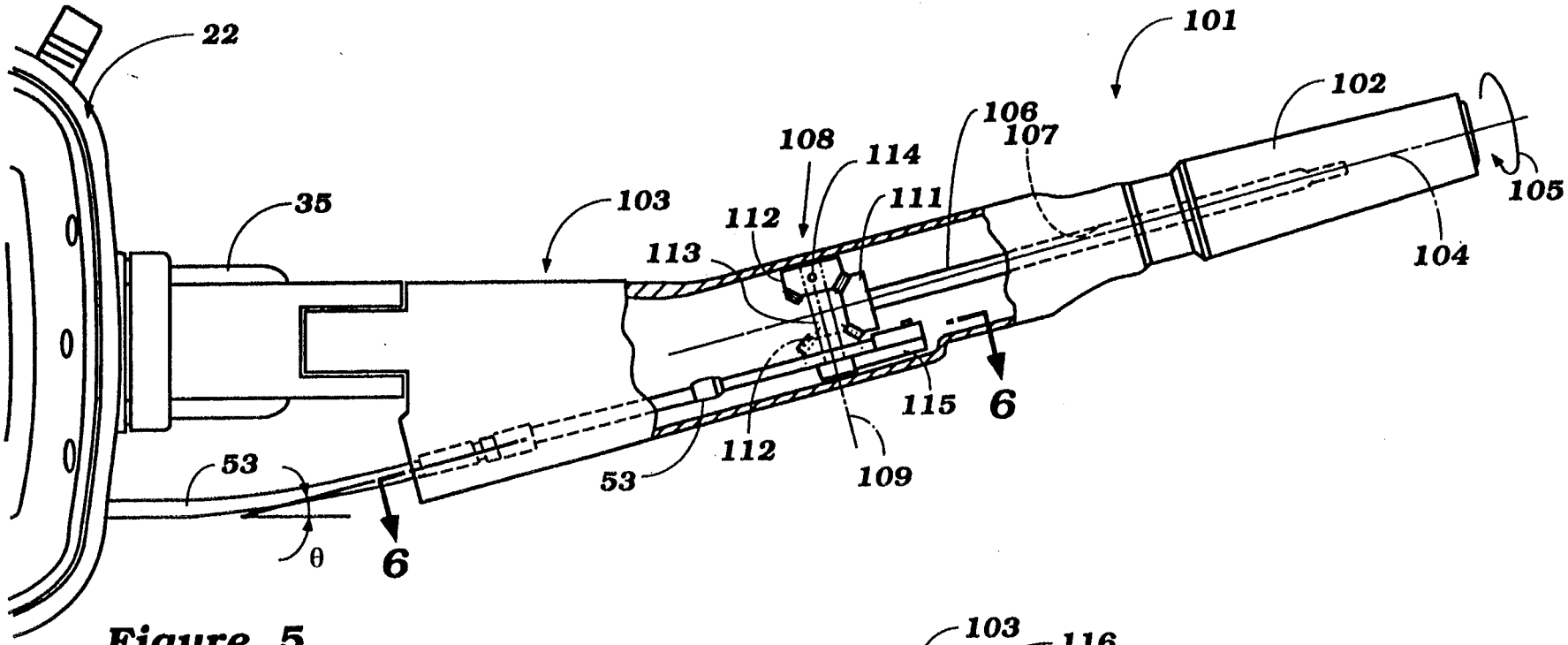
FIG. 5 is an enlarged top plan view, in part similar to FIG. 2, and shows a first embodiment of the invention.

As may be seen in FIG. 5, this construction permits the throttle control wire 53 to be bent through a very small angle $\theta$ for its connection and no substantial exposed portion of the throttle control 53 exist. Hence, this not only presents a neat assembly, but it reduces stresses on the wire actuator 53 and avoids entanglement.

FIGS. 7 through 11 show another embodiment of the invention which is generally the same as the embodiment of FIGS. 5 and 6, but which also incorporates a transmission control and an interlock for controlling the speed of the engine when the transmission is shifted in other than a forward drive mode and also which prohibits shifting of the transmission into certain gears when the engine is operating at a higher than desired speed. Because this embodiment has some components which are the same as the prior art and additional components which are the same as the embodiment of FIGS. 5 and 6, those components which are the same have been identified by the same reference numerals and they will not be described further, except insofar as is necessary to understand the construction and operation of this embodiment.

Figure 4:
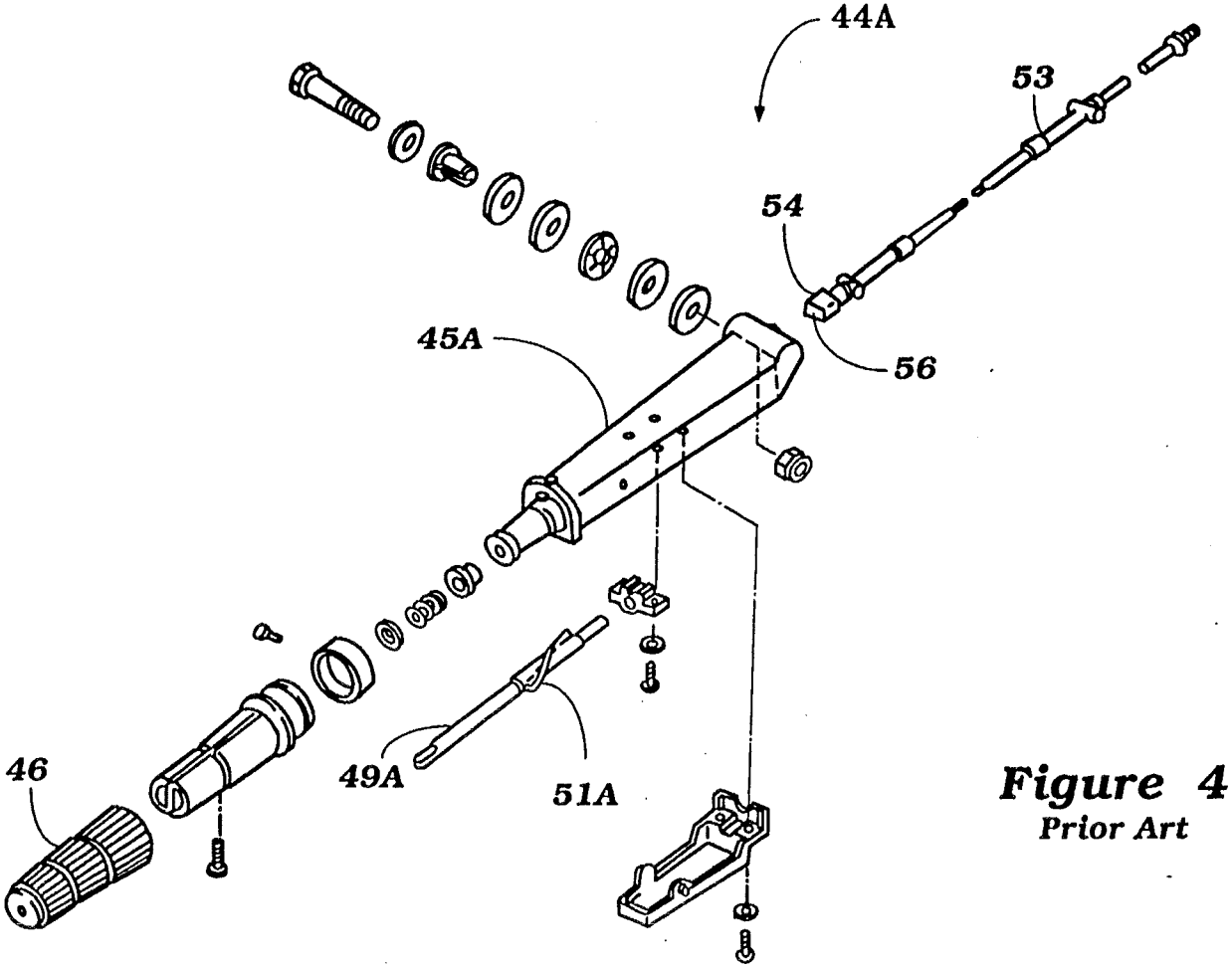
Figure 4 Prior Art
FIG. 4 is an exploded perspective view of another type of prior art construction.

FIG. 4 shows the details of the bevel gear transmission for accomplishing the forward, neutral, reverse drive and this transmission includes the aforenoted drive shaft which appears partially in this Figure and is identified by the reference numeral 57 which is contained within the lower unit 28 and which drives a bevel gear 58. This bevel gear 58 is enmeshed with a pair of oppositely rotating driven bevel gears 59 and 61 that are journalled on a propeller shaft 62 to which the propeller 29 is affixed. The driven bevel gears 59 and 61 have dog clutching teeth which face a dog clutching element 63 that is fixed for rotation with the propeller shaft 62 but which is axially moveable with it. This clutching element 63 is moved axially by a cam mechanism 64 operated by a vertically extending shift rod 65 having an operating portion 66 at its upper end which is connected to the transmission control wire 41 previously described.

Now referring to the details of the steering and control which, in this embodiment, is identified generally by the reference numeral 151, it includes an outer housing 152 on which the throttle control portion 102 is rotatably journalled and which is coupled to the throttle control wire actuator 53 in the same manner as in the embodiment of FIGS. 5 and 6 and, therefore, those interconnecting components have been identified by the same reference numerals and will not be described again in detail, except so as to indicate the interrelationship between the throttle and transmission controls.

In this embodiment, the outer housing 103 is provided with a boss 152 that has a bore 153 in which a bearing portion of a transmission control lever 154 is journalled for rotation about an axis 155 that extends parallel to the axis of rotation of the shaft 103 of the throttle control mechanism and traversely to the axis 104. The shift control lever 154 is thus journalled for rotation between a forward drive position, a neutral position and a reverse drive position as shown by the letters F, N, R in FIG. 9.

Within the outer housing 103, the shift lever 154 is provided with a further lever arm 156 that has an arm portion 157 that extends across the upper end of the throttle control shaft 106 and which has an upwardly extending boss 158 to which the transmission control 41 is connected by means of a connector 159. Hence, the transmission control rod 65 is controlled by the position of the shift lever 154 carried on the handle assembly 151 in the manner as thus far described.

For the reasons previously noted, it is desirable to limit the speed at which the engine 23 may be driven when the transmission is shifted into neutral or reverse and also to prevent shifting of the transmission into these modes when the throttle is opened more than a predetermined extent. An interlock mechanism, indicated generally by the reference numeral 161 is provided for this purpose. The interlock mechanism 161 is comprised of a stop portion 162 that is formed integrally with the underside of the throttle control lever portion 57 and which faces generally downwardly as seen in the Figures.

This portion 162 cooperates with a throttle actuated member 163 which is affixed to the throttle control shaft 106 in a known manner and which has a pair of arm portions 164 and 165 which form the neutral and reverse throttle limiting mechanisms, respectively. A pair of adjusting screws 166 and 167 have a threaded connection with the arms 164 and 165, respectively and face upwardly toward the stop 162 of the shift lever 154. The stop 162 of the shift lever 154 also has forward, neutral and reverse positions and these are indicated by f, n and r, respectively, in FIG. 9.

Figure 9:
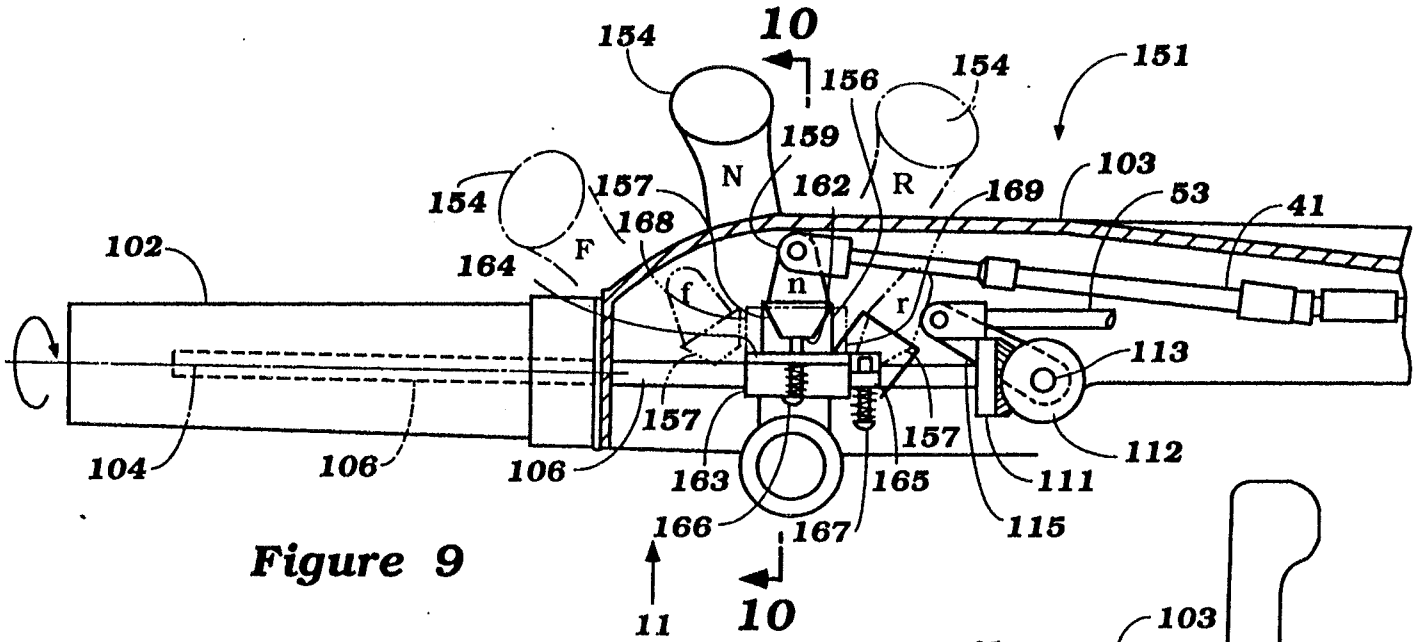
FIG. 9 is an enlarged cross sectional view taken through the steering handle of this embodiment.
Figure 10:
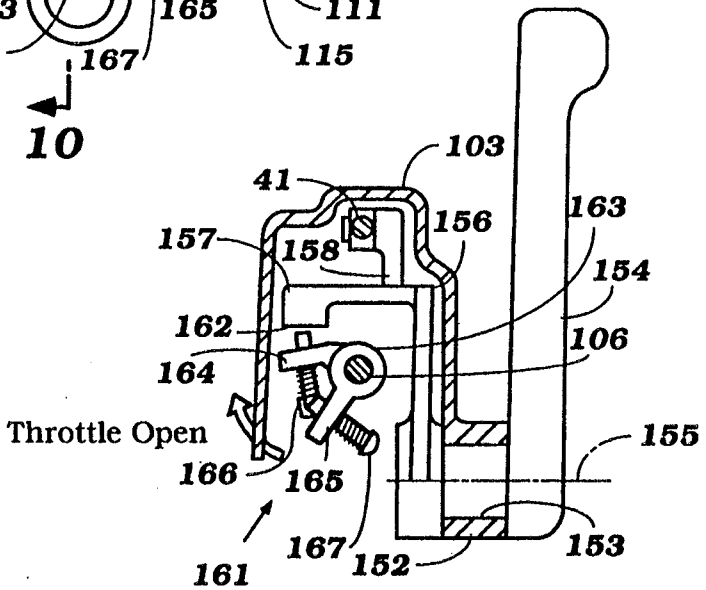
FIG. 10 is a cross sectional view taken along the line 10—10 of FIG. 9.
Figure 11:
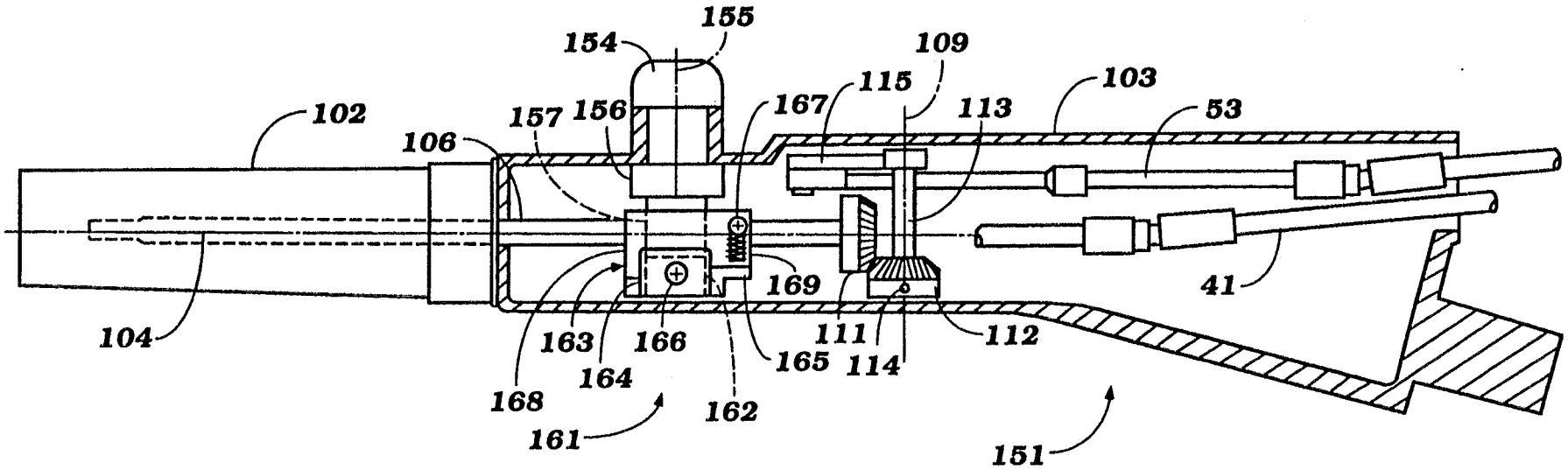
FIG. 11 is a bottom plan view of this embodiment and is taken generally in the direction of the arrow 11 in FIG. 9.

As may be seen in FIG. 9, when the shift control lever 154 is positioned in its forward F position, the stop 162 of the shift control lever will be positioned forwardly of the stop assembly 161 and the throttle control knob 102 may be rotated between its fully opened and fully closed positions without interference.

When the shift lever 154 is moved to its neutral position, then the stop member 162 will be positioned in registry with the arm 164 of the stop member 163 and if attempts are made to open the throttle, the stop screw 166 will engage the stop member 162 in its neutral n position and lower the degree of opening of the throttle.

In a similar manner, when the shift lever 154 is its reverse R position, then the throttle control 102 can only be rotated to the point when the stop screw 167 engages the abutment 162 and a reduced speed of the engine will be controlled. It should be noted that the engine can be driven faster in reverse than in neutral. However, it is also desirable to limit the speed to a relatively low speed when operating in reverse.

The control and interlock 161 also precludes the shifting of the transmission from one position to another dependent upon the position of the throttle control 102 and for this purpose, the stop portions 164 and 165 are provided with respective stop shoulders 168 and 169. The operation of these stop shoulders may be best understood by reference to FIG. 9.

Assuming first that the shift control lever 154 is in its forward drive position F, it is not possible to shift into neutral N until the throttle control 102 is rotated sufficiently so as to bring the stop portion 168 out of obstructing relationship with the throttle control lever portion 157. In fact, the transmission cannot be moved completely into neutral until the neutral stop screw 166 is positioned so that the abutment 162 can clear it. Hence, the transmission cannot be shifted into neutral until the engine is at a speed at least no greater than the maximum neutral permitted speed. Of course, the transmission can be shifted from neutral to forward at any speed.

If the shift control lever 154 is in reverse R, it cannot be shifted into neutral unless the speed of the engine is dropped to the reverse neutral speed because the abutment 169 will interfere with movement of the shift control lever 154 to the neutral drive position until not only the abutment 169 is cleared, but also until the throttle is in a position wherein the neutral stop screw 166 will not interfere with this movement. However, shifting from neutral to reverse at this speed is freely permitted.

Thus, it should be readily apparent that this embodiment is effective in controlling the maximum speed of the engine in each gear and for preventing shifting between the gears until the speed is at the maximum speed permitted for the gear to be shifted into. This is all accomplished by the interlock mechanism as contained within the control mechanism 151.

Figure 2:
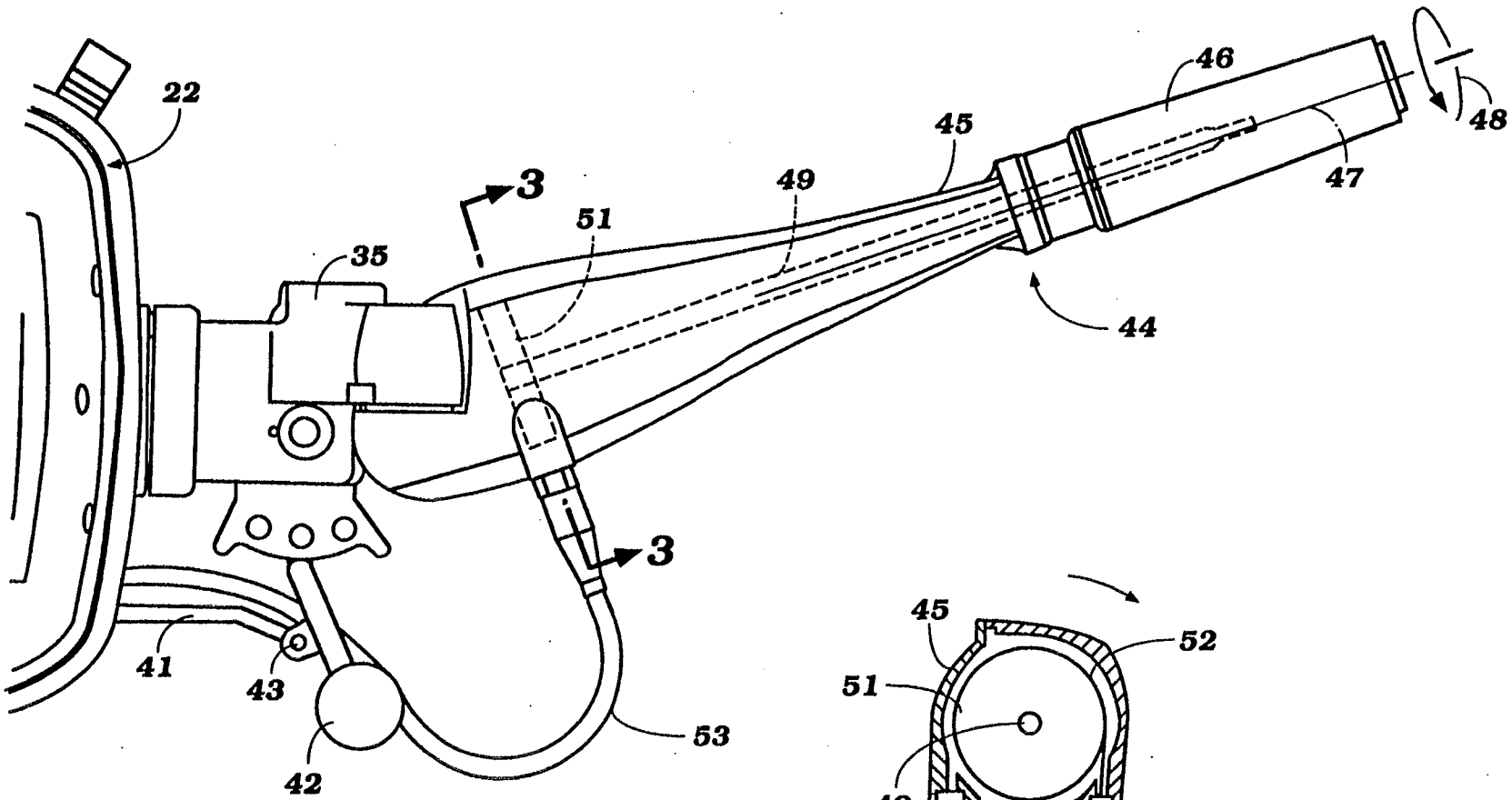
Figure 2 Prior Art
FIG. 2 is an enlarged top plan view of a prior art type of steering and throttle control for an outboard motor.
Figure 3:
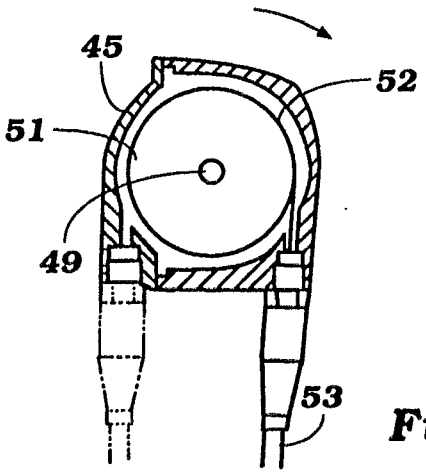
Figure 3 Prior Art
FIG. 3 is a cross sectional view taken along the line 3—3 of FIG. 2.
Figures 12, 13:
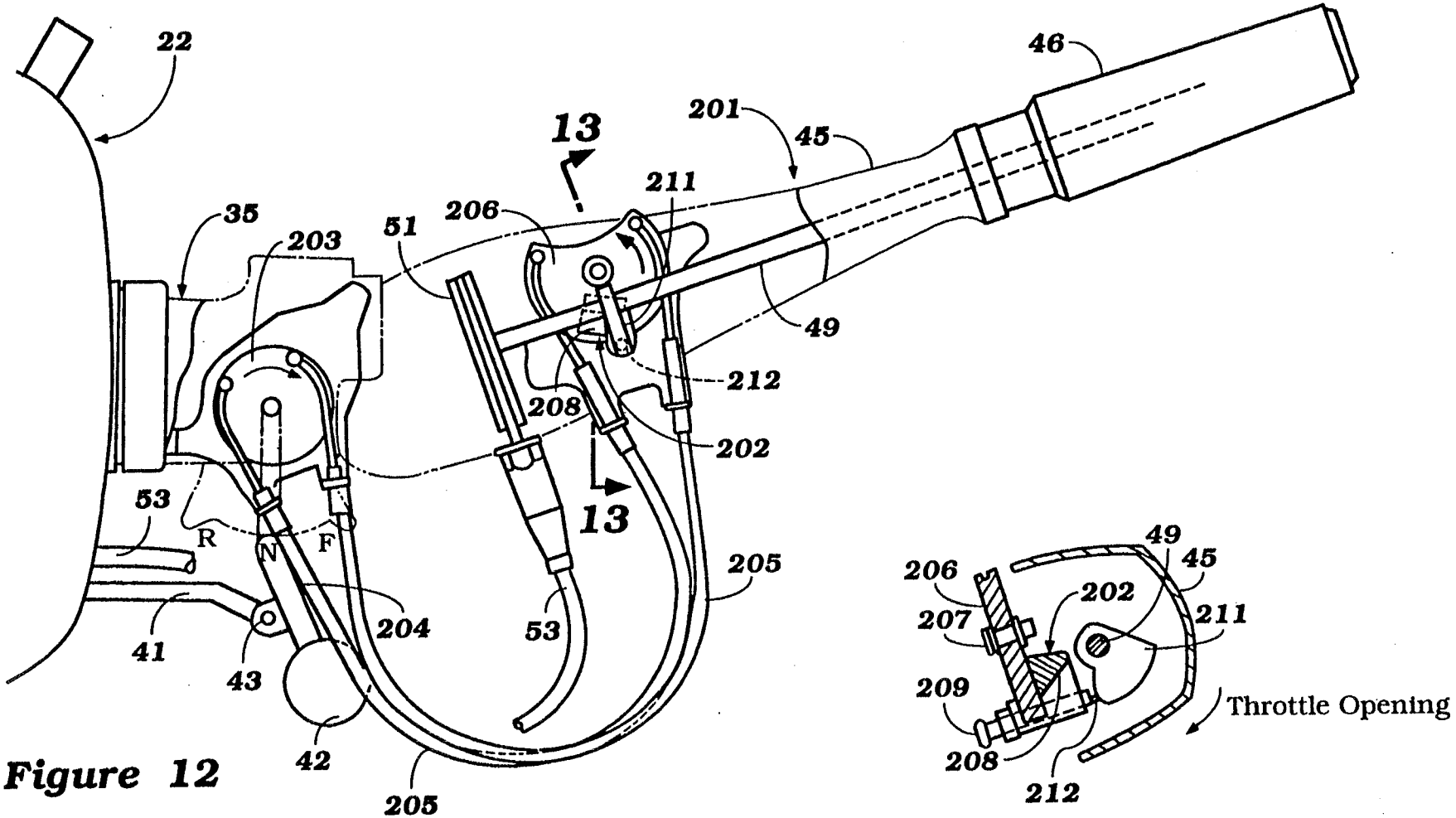
FIG. 12 is a top plan view, with portions shown in phantom, in part similar to FIGS. 5 and 8, and shows another embodiment of the invention.
FIG. 13 is a cross sectional view taken along the line 13—13 of FIG. 12.

FIGS. 12 and 13 show another embodiment of the invention which, although lacking all of the advantages of the embodiment of FIGS. 7 through 11, shows how the transmission throttle control interlock may be provided in conjunction with a prior art type of construction as shown in FIGS. 2 and 3. Because of this similarity to the embodiment of FIGS. 2 and 3, components of this embodiment which are the same as that embodiment have been identified by the same reference numerals and will be described again in detail only insofar as is necessary to understand the construction and operation of this embodiment.

In this embodiment, the steering and interlock control is identified generally by the reference numeral 201 and differs from the prior art construction of FIGS. 2 and 3 by having a transmission throttle control interlock mechanism, indicated generally by the reference numeral 202, which is mounted primarily in the outer housing 45 of the control. There is an externally mounted component and this includes a pulley 203 which is mounted for rotation about a vertically extending axis suitably on the steering arm 35 and to which a lever arm 204 of the shift control knob is affixed for rotating the pulley 203 upon movement of the shift control knob 42 between its forward, neutral and reverse positions shown at F, N and R in FIG. 12.

A pair of bowden wires 205 interconnect the pulley 203 to a corresponding pulley 206 that is rotatably journalled in the handle assembly 45 on a support pin 207. The pulley 206 includes a reverse stop cam 208 and an adjustable idle stop screw 209 which cooperate with a throttle position cam 211 carrying a stop pin 212 which is affixed for rotation with the throttle control rod 49. FIGS. 12 and 13 show the construction in the neutral N position and in this position, the adjustable neutral stop screw 209 is in confronting relationship to the pin 212 and will limit the degree of rotation for the throttle control 46 and throttle control shaft 49 in the throttle opening position as clearly shown. In this position, however, the transmission may be shifted from neutral into forward or reverse freely. Hence, the transmission control and interlock is from neutral to forward or reverse is the same as in the embodiment of FIGS. 7 through 11.

If the transmission is shifted into the forward drive position by rotation of the shift lever 42 in counter-clockwise direction, the wire actuators 205 will rotate the interlock pulley 206 in a clockwise direction and the control mechanism 202 will be moved away from interference with the throttle cam 211 and full opening and closing of the throttle will be permitted. However, it should be noted that if the throttle is open wider than the neutral maximum position, the transmission cannot be shifted back into neutral until the speed is reduced to this speed. Thus, again like the previously described embodiment, transmission and throttle interlock is provided.

Considering now that the transmission is to be shifted into reverse from the neutral position as shown in FIGS. 12 and 13, the operator moves the shift lever 242 in a forward direction so as to rotate in a clockwise direction as shown by the arrow in FIG. 12. This movement is transmitted to the shift control pulley 206 to rotate it in a counter-clockwise direction and the cam 208 will approach the throttle control lever 211. If the throttle is opened too widely, then shifting into reverse will be precluded. Assuming, however, that this is not the case, then the upper portion of the cam 208 will underlie the pin 212 and the throttle can be opened at a wider degree than in neutral, but still not fully wide open. However, the transmission cannot be moved back to neutral until the speed of the engine is reduced to the maximum neutral permitted speed, as with the previously described embodiment.

In view of the foregoing description, it should be readily apparent that the described embodiments of the invention are very effective in permitting the easy addition of a steering handle to a large or medium displacement outboard motor that is not designed normally to be operated with a steering handle and throttle and/or transmission control can be accomplished in a neat and facile manner. In addition, if desired, an interlock mechanism can be provided between the transmission and throttle controls so as to avoid overspeed in transmission ratios other than forward. Of course, the foregoing description is that of preferred embodiments of the invention and various changes and modifications may be made without departing from the spirit and scope of the invention, as defined by the appended claims.

I claim:

1. A combined steering handle and control for an outboard motor having a controlled element and a wire actuator connected to said controlled element for operating said controlled element, said wire actuator having an end extending forwardly from said outboard motor, said steering handle and control comprising a main body portion adapted to be affixed to said outboard motor for effecting steering movement of said outboard motor, a control portion rotatably journalled at a forward end of said body portion about a longitudinally extending axis, motion transmitting means contained within said main body portion for transmitting rotary motion of said control portion about said longitudinal axis into rotation of an operating element about an axis transverse to said longitudinal axis, and connecting means for connecting said wire actuator end to said operating element.

2. A combined steering handle and control for an outboard motor as set forth in claim 1 wherein the operating element comprises a lever supported for pivotal movement about the transverse axis by the main body portion.

3. A combined steering handle and control for an outboard motor as set forth in claim 2 wherein the connecting means effects a connection of the wire actuator to the lever at point spaced outwardly from the motion transmitting means.

4. A combined steering handle and control for an outboard motor as set forth in claim 3 wherein the motion transmitting means comprises a bevel gear transmission.

5. A combined steering handle and control for an outboard motor as set forth in claim 4 wherein the lever is affixed for rotation with a driven bevel gear at one side of the main body portion.

6. A combined steering handle and control for an outboard motor as set forth in claim 1 wherein the main body portion is adapted to be pivotally connected to the outboard motor about a horizontally disposed axis.

7. A combined steering handle and control for an outboard motor as set forth in claim 6 wherein the operating element comprises a lever supported for pivotal movement about the transverse axis by the main body portion.

8. A combined steering handle and control for an outboard motor as set forth in claim 7 wherein the connecting means effects a connection of the wire actuator to the lever at point spaced outwardly from the motion transmitting means.

9. A combined steering handle and control for an outboard motor as set forth in claim 8 wherein the motion transmitting means comprises a bevel gear transmission.

10. A combined steering handle and control for an outboard motor as set forth in Claim 9 wherein the lever is affixed for rotation with a driven bevel gear at one side of the main body portion.

11. A combined steering handle and control for an outboard motor as set forth in claim 10 wherein the controlled element of the outboard motor comprises a throttle control for controlling the speed of the outboard motor.

12. A combined steering handle and control for an outboard motor as set forth in claim 1 wherein the controlled element of the outboard motor comprises a throttle control for controlling the speed of the outboard motor.

13. A combined steering handle and control for an outboard motor as set forth in claim 12 wherein the outboard motor is further provided with a transmission having a transmission operating element connected to a transmission wire actuator and a shift lever journalled by said main body portion and connected to said transmission wire actuator.

14. A combined steering handle and control for an outboard motor as set forth in claim 13 wherein the transmission is operable in a forward speed and one other speed.

15. A combined steering handle and control for an outboard motor as set forth in claim 14 further including mechanical interlock means between the transmission control and the throttle control contained within the main body portion for limiting the speed of the engine when the transmission is in the speed other than the forward speed.

16. A combined steering handle and control for an outboard motor as set forth in claim 15 wherein the mechanical interlock means prohibits shifting of the transmission from the forward speed to the other speed when the throttle control is opened more than a predetermined amount.

17. A combined steering handle and control for an outboard motor as set forth in claim 15 wherein the transmission other speed comprises a reverse speed and further including a neutral speed.

18. A combined steering handle and control for an outboard motor as set forth in claim 17 wherein there are provided mechanical interlock means for limiting the speed of the engine when the transmission is in the neutral speed and in the reverse speed.

19. A combined steering handle and control for an outboard motor as set forth in claim 18 wherein the maximum speeds in the neutral position and in the reverse position are independently adjustable.

20. A tiller control for the steering, throttle control and transmission control of an outboard drive having an engine speed controlling throttle and a transmission shiftable between at least a forward drive position and one other position, said tiller control comprises a handle assembly adapted to be detachably affixed to said outboard drive, a throttle control movably supported relative to said handle assembly, a transmission control movably supported by said handle assembly between a forward drive position and another drive position, first motion transmitting means for interconnecting said throttle control to said outboard motor throttle, second motion transmitting means for connecting said transmission control to said outboard drive transmission, and mechanical interlock means being positioned between said throttle control and said transmission control and interconnecting said motion transmitting means for limiting the position of said throttle control when said transmission control is in its other forward drive position.

21. A tiller control for the steering, throttle control and transmission control of an outboard drive as set forth in claim 20 wherein the mechanical interlock means is contained within a main body portion of the handle assembly.

22. A tiller control for the steering, throttle control and transmission control for an outboard motor as set forth in claim 21 wherein the mechanical interlock means prohibits shifting of the transmission from the forward position to the other position speed when the throttle control is opened more than a predetermined amount.

23. A tiller control for the steering, throttle control and transmission control for an outboard motor as set forth in claim 21 wherein the transmission other position comprises a reverse position and further including a neutral position.

24. A tiller control for the steering, throttle control and transmission control for an outboard motor as set forth in claim 23 wherein there are provided mechanical interlock means for limiting the speed of the engine when the transmission is in the neutral position and in the reverse position.

25. A tiller control for the steering, throttle control and transmission control for an outboard motor as set forth in claim 24 wherein the maximum speeds in the neutral position and in the reverse position are independently adjustable.

* * * * *